US006624687B1

(12) United States Patent
Burr

(10) Patent No.: US 6,624,687 B1
(45) Date of Patent: Sep. 23, 2003

(54) METHOD AND STRUCTURE FOR SUPPLY GATED ELECTRONIC COMPONENTS

(75) Inventor: James B. Burr, Foster City, CA (US)

(73) Assignee: Sun Microsystems, Inc., Santa Clara, CA (US)

( * ) Notice: Subject to any disclaimer, the term of this patent is extended or adjusted under 35 U.S.C. 154(b) by 38 days.

(21) Appl. No.: 09/872,828

(22) Filed: May 31, 2001

(51) Int. Cl.[7] ..... G05F 3/02
(52) U.S. Cl. ..... 327/546; 327/544
(58) Field of Search ..... 327/544, 389, 327/534, 535, 537, 546

(56) References Cited

U.S. PATENT DOCUMENTS

| | | | | | |
|---|---|---|---|---|---|
| 4,365,172 | A | * | 12/1982 | Prater | 326/112 |
| 5,471,421 | A | | 11/1995 | Rose et al. | 365/182 |
| 5,566,120 | A | | 10/1996 | D'Souza | 365/227 |
| 5,581,500 | A | | 12/1996 | D'Souza | 365/154 |
| 5,594,371 | A | | 1/1997 | Douseki | 326/119 |
| 5,606,270 | A | | 2/1997 | D'Souza et al. | 326/98 |
| 5,612,645 | A | | 3/1997 | Halepete | 327/537 |
| 5,622,880 | A | | 4/1997 | Burr et al. | 438/194 |
| 5,640,115 | A | | 6/1997 | Halepete et al. | 327/219 |
| 5,650,340 | A | | 7/1997 | Burr et al. | 437/30 |
| 5,719,422 | A | * | 2/1998 | Burr et al. | 257/336 |
| 5,751,170 | A | | 5/1998 | Pyeon | 327/57 |
| 5,753,958 | A | | 5/1998 | Burr et al. | 257/392 |
| 5,773,863 | A | | 6/1998 | Burr et al. | 257/344 |
| 5,780,912 | A | | 7/1998 | Burr et al. | 257/408 |
| 5,783,958 | A | | 7/1998 | Lysinger | 327/202 |
| 5,916,237 | A | * | 6/1999 | Schu | 600/522 |
| 5,923,987 | A | | 7/1999 | Burr | 438/304 |
| 5,942,781 | A | | 8/1999 | Burr et al. | 257/347 |
| 5,982,211 | A | | 11/1999 | Ko | 327/202 |
| 5,985,727 | A | | 11/1999 | Burr | 438/302 |
| 5,998,850 | A | | 12/1999 | Burr | 257/428 |
| 6,031,778 | A | | 2/2000 | Makino et al. | 365/226 |
| 6,048,746 | A | | 4/2000 | Burr | 438/17 |
| 6,072,217 | A | | 6/2000 | Burr | 257/351 |
| 6,087,892 | A | | 7/2000 | Burr | 327/534 |
| 6,091,283 | A | | 7/2000 | Murgula et al. | 327/537 |
| 6,093,951 | A | | 7/2000 | Burr | 257/408 |
| 6,100,567 | A | | 8/2000 | Burr | 257/365 |
| 6,110,783 | A | | 8/2000 | Burr | 438/286 |
| 6,118,328 | A | | 9/2000 | Morikawa | 327/534 |
| 6,121,666 | A | | 9/2000 | Burr | 257/408 |
| 6,133,762 | A | * | 10/2000 | Hill et al. | 326/112 |
| 6,137,142 | A | | 10/2000 | Burr | 257/349 |
| 6,190,954 | B1 | | 2/2001 | Lee et al. | 438/199 |
| 6,211,725 | B1 | | 4/2001 | Kang | 327/534 |
| 6,231,147 | B1 | | 5/2001 | Bosshart | 327/212 |
| 6,255,853 | B1 | * | 7/2001 | Houston | 326/121 |
| 6,310,487 | B1 | | 10/2001 | Yokomizo | 324/769 |
| 6,329,874 | B1 | | 12/2001 | Ye et al. | 327/544 |

* cited by examiner

*Primary Examiner*—Kenneth B. Wells
*Assistant Examiner*—Cassandra Cox
(74) *Attorney, Agent, or Firm*—Gunnison, McKay & Hodgson, L.L.P.; Philip J. McKay

(57) ABSTRACT

A method and structure for supply gating low power electronic components uses low threshold gating transistors. The low power components operate at supply voltages of less than one volt and typically in the range of 150 to 400 millivolts. Using low threshold gating transistors, the leakage current of the devices, and therefore the standby power dissipation, can be minimized by using any one, or a combination of, four methods including: overdriving the low threshold gating transistors on; overdriving the low threshold gating transistors off; combining very low threshold device transistors with low threshold gating transistors; and providing the low threshold gating transistors with back bias.

1 Claim, 8 Drawing Sheets

METHOD AND STRUCTURE FOR SUPPLY GATED ELECTRONIC COMPONENTS

FIELD OF THE INVENTION

The present invention relates generally to transistor devices and, more particularly, to low power and ultra-low power MOS devices including low power supply gating transistors.

BACKGROUND OF THE INVENTION

With the emergence of an electronics market that stresses portability, compact size, lightweight and the capability for prolonged remote operation, a demand has arisen for low power and ultra-low power transistor components and systems. To meet this demand, devices are emerging which have extremely low threshold voltages. Low threshold voltage devices use less power for active operation and are typically faster. However, in addition to low active power usage, it is also important that the devices have very small power dissipation in a standby mode, i.e., that the devices have very small leakage currents and, therefore, use very little power in standby mode.

There are a number of factors that contribute to the magnitude of a transistor's threshold voltage. For example, to set a transistor's threshold voltage near zero, light doping and/or counter doping in the channel region of the transistor may be provided. Lowering the threshold voltage of a transistor typically decreases active power dissipation by permitting the same performance to be achieved at a lower supply voltage. However, lowering the threshold voltage of a transistor normally increases standby power dissipation by increasing transistor leakage current. Consequently, devices having low threshold voltages can leak so much current when their circuits are in a sleep or standby mode that the gains made by lowering the threshold voltage are outweighed by the power lost to leakage.

In the discussion that follows, an NFET is used as an example. However, those of skill in the art will readily recognize that a PFET will behave in essentially the same manner with reversed polarities. An NFET is therefore chosen for simplicity and to avoid detracting from the invention.

FIG. 1A is a schematic representation of a typical transistor 101 having a drain 103, a source 105 and a gate 107. As is well known in the art, if transistor 101 is an NFET, then transistor 101 is typically in an "off" or "standby" condition when the voltage on gate 107 (Vg) is sufficiently below a threshold voltage (Vth). However, as is also well known in the art, even when transistor 101 is in the "off" or "standby" state, there is still a leakage current from drain 103 to source 105.

FIG. 1B graphically represents the curve 110 of the voltage between the gate and the source (Vgs), on the horizontal axis 115, versus the log of the current between the drain and the source (Ids), on the vertical axis 117, for a typical prior art standard CMOS NFET transistor. As seen in FIG. 1B, Ids has a minimal value 113 in portion 119 of curve 110, as Vgs approaches zero volts and the transistor is driven into standby mode. However, Ids remains at minimal value 113 and is therefore typically never brought down to zero amps, even as Vgs goes negative. In portion 121 of curve 110, Ids increases exponentially to point 111 when Vgs is equal to Vth. After Vth is reached, and the transistor is in active mode, Ids increases as a quadratic function along portion 123 of curve 110 and substantially levels off from point 125 forward.

In a typical standard CMOS NFET, the leakage current, i.e., the current at point 113 in FIG. 1B is on the order of one pico-ampere ($10^{-12}$ ampere) per micron. In addition, some newer transistors have 0.18-micron feature sizes and have leakage currents on the order of a nanoamp ($10^{-9}$ ampere) per micron. Consequently, devices including one hundred million of these new transistors and using a standard 1.8 volt supply voltage leak on the order of 0.1 ampere and dissipate 180 milliwatts of power in standby.

While the leakage currents discussed for standard CMOS transistors are less than ideal, they were largely tolerated in the prior art and, in standard CMOS, were not considered a fatal flaw. As discussed in more detail below, for low threshold transistors, leakage currents are not only significant but are a fatal flaw that can completely overshadow the advantages of these transistors and make them unworkable components.

Returning to the discussion of standard CMOS devices, if it were necessitated, one method to reduce the leakage current in standard CMOS would be to provide gating transistors to isolate the device from the voltage sources. FIG. 2 shows a prior art supply gated device 200 including a device 201, a first prior art gate transistor 203, coupled between first supply voltage 207 and device 201, and a second prior art gate transistor 205, coupled between device 201 and a second supply voltage 209. Device 201 could be any one of numerous devices well known to those of skill in the art such as a single transistor, an inverter, a latch, any one of several gates, or any other logic or memory devices. In FIG. 2, prior art gate transistor 203 is a PFET and includes a source 211, a gate 213 and a drain 215. Likewise, in FIG. 2, prior art gate transistor 205 is an NFET and includes a drain 221, a gate 223 and a source 225.

In standard CMOS, the difference in potential between first supply voltage 207 and second supply voltage 209 was on the order of two (2.0) volts. In one embodiment, first supply voltage 207 was a positive two-volt supply while second supply voltage 209 was ground, thus giving the typical two-volt differential.

The addition of prior art gating transistors 203 and 205 to device 201 helped control leakage current by providing a capability to isolate device 201 from first supply voltage 207 and second supply voltage 209. This capability was provided by using prior art gating transistors 203 and 205 as switches controlled by a voltage supplied to gates 213 and 223 of prior art gating transistors 203 and 205, respectively. Unfortunately, the addition of prior art gating transistors 203 and 205 meant that an additional transistor was added to each current path, i.e., prior art gating transistors 203 and 205 each added a resistance in series to the path between device 201 and the first and second supply voltages 207 and 209, respectively. This added resistance meant decreased performance and decreased device speed. The performance reduction due to the addition of prior art gating transistors 203 and 205 could be partially offset by increasing the size of prior art gating transistors 203 and 205 relative to the size of the transistors making up device 201. However, even a ten fold increase in relative size of prior art gating transistors 203 and 205 compared to the transistors in device 201 would still typically yield a decrease in performance of about ten percent for gated device 200 compared with a non-gated device.

A theoretical way to minimize the decrease in performance of device 201 due to the addition of prior art gating transistors 203 and 205 would be to drive prior art gating transistors 203 and 205 at a higher voltage than the voltage driving device 201. However, in practice, to actually make any significant difference in the performance, i.e., to significantly decrease the resistance added by prior art gating transistors 203 and 205, the supply voltages of prior art gating transistors 203 and 205 would need to be multiples, and preferable an order of magnitude, larger than the differential between first supply voltage 207 and second supply voltage 209. However, as noted above, in standard 0.18 micron CMOS technology, the voltage differential between first supply voltage 207 and second supply voltage 209 is on the order of two volts, the maximum tolerated over time by the 36 angstrom gate oxide. Consequently, the voltage differential required to significantly decrease the added resistance of prior art gating transistors 203 and 205 could not be withstood by standard CMOS transistors over time and prior art gating transistors 203 and 205 would eventually break down.

As discussed above, the addition of prior art gating transistors 203 and 205 would significantly decrease performance of device 201. Consequently, in the prior art, other techniques such as clock gating, i.e., isolating the device from the system clock as opposed to isolating the device from the supply voltages, were used. In large part however, the problem of leakage current was not considered a significant problem in prior art standard CMOS because the threshold voltages were relatively high and leakage current was not large (see point 113 of curve 110 in FIG. 1A). Indeed, the performance of prior art standard CMOS transistors was typically tailored to meet a predetermined and acceptable level of leakage current required to meet standby power limits.

As noted above, the level of leakage current in prior art standard CMOS transistors and devices was considered acceptable. However, as also noted above, it is highly desirably to lower the threshold voltage of a transistor to decrease active power dissipation by permitting the same performance to be achieved at a lower supply voltage. However, lowering the threshold voltage of a transistor normally increases standby power dissipation by increasing leakage current and devices having low threshold voltages can leak so much current when their circuits are in a sleep or standby mode that the gains made by lowering the threshold voltage are outweighed by the power lost to leakage.

FIG. 3 graphically represents the curve 310 of the voltage between the gate and the source (Vgs), on the horizontal axis 315, versus the log of the current between the drain and the source (Ids), on the vertical axis 317, for a typical low threshold NFET. Note that curve 310 for a low threshold NFET in FIG. 3 has substantially the same shape as curve 110 for a standard CMOS NFET shown in FIG. 1A. However, curve 310 in FIG. 3 is essentially shifted to the left as a result of lowering the threshold voltage of the device. As seen in FIG. 3, Ids has a minimal value 313 in portion 319 of curve 310. However, in FIG. 3, minimum value 313, and portion 319, lies in the region of curve 310 where Vgs is negative. Consequently, as Vgs approaches zero volts and the transistor is driven into standby mode, the Ids value 311 is relatively high. As a result, leakage current is also relatively high. This is in contrast to minimum value 113 for a standard CMOS transistor, as shown in FIG. 1B, which is reached as Vgs moves towards zero and the transistor goes into standby mode. In addition, in FIG. 3, portion 321 of curve 310, where Ids increases exponentially to point 311, i.e., to the point where Vgs is equal to Vth, is also almost entirely in the portion of curve 310 where Vgs is negative. This too is in direct contrast to curve 110 of FIG. 1B. In FIG. 3, after Vth is reached, and the transistor is in active mode, Ids increases as a quadratic function along portion 323 of curve 310 and substantially levels off from point 325 forward.

In a typical low threshold NFET, the leakage current, i.e., the current at point 313 in FIG. 3 is on the order of one microamp ($10^{-6}$ ampere) per micron. In contrast, recall that in standard CMOS devices the leakage current was on the order of one pico-ampere to one nanoamp per micron ($10^{-12}$ to $10^{-9}$ ampere). Consequently, devices having one hundred million low threshold transistors and using a low power supply voltage of 200 millivolts, dissipate on the order of twenty (20.0) watts of power in standby. Clearly, this is not acceptable in many applications.

As shown above, it is particularly desirable in low-threshold devices to provide a mechanism for modulating the threshold voltage to account for variations. Modulating the threshold voltage of a device can be accomplished using back biasing, i.e. controlling the potential between a device's well and source. See James B. Burr, "Stanford Ultra-Low Power CMOS," Symposium Record, Hot Chips V, pp. 7.4.1–7.4.12, Stanford, Calif. 1993, which is incorporated, in its entirety, herein by reference. Back biasing is used to modulate the threshold voltages of the transistors between an off state and an on state. Typically, the potential will be controlled through isolated contacts to the source and well regions together with circuitry necessary for independently controlling the potential of these two regions.

While modulating the threshold voltage using back biasing provides a mechanism for at least partially controlling leakage current in a low power device, there are definite limits to the ability to significantly decrease leakage current using back biasing alone. This is because the use of back biasing to control leakage current relies on the well-known body effect of the device and the body effect decreases with a decrease in threshold voltage. Consequently, the ability to modulate the threshold voltages of the transistors between an off state and an on state, and therefore to control leakage current using back biasing alone, decreases as the threshold voltage decreases.

What is needed is a method and apparatus for decoupling the power dissipation of a device in standby mode from leakage current by using circuitry to control the leakage current in low threshold transistors and devices.

SUMMARY OF THE INVENTION

According to the invention, low power devices are provided with low threshold gating transistors. According to the invention, the low power devices operate at supply voltages of less than one volt and typically in the range of 150 to 400 millivolts. Using low threshold gating transistors according to the invention, the leakage current of the devices, and therefore the standby power dissipation, can be minimized by using any one of, or a combination of, four methods.

First, since the devices of the invention are low power, and the supply voltages are so low, the gating transistors of the invention can be overdriven on, i.e., provided gate to source voltages (Vgs) significantly larger than the device supply voltage, in one embodiment tens times as large, without causing the destruction of the gating transistor. For instance, in one embodiment of the invention, the device supply voltage is 200 millivolts while the Vgs is on the order of 2.0 volts. This is in direct contrast to prior art gating transistors that had to be driven at essentially the same Vgs as the supply voltage to avoid transistor breakdown. By overdriving the gating transistors of the invention, the resistance added to the device by the gating transistors is decreased significantly without resorting to increasing the size of the transistor, as was done in the prior art. In addition, if even less resistance is desired, the size of the gating transistors of the invention can be increased and the transistor can still be overdriven according to the invention. Consequently, using the invention, there is an approach for resistance reduction available that was not available in the prior art and can provide orders of magnitude decrease in added resistance. Therefore, the invention can provide the advantages of supply gating without the large performance penalty associated with the prior art.

Second, since the threshold voltages of the supply gating transistors of the invention are so low, the gating transistors of the invention can be overdriven off to further decrease leakage. Indeed, a negative gate voltage of as little as −200 millivolts can reduce leakage by three orders of magnitude or more. By overdriving the gating transistors of the invention off, the transistor can be forced into an off condition where the leakage current is optimized. For instance, using an NFET low threshold gating transistor, Vgs can be made negative so that the drain to source current (Ids) is forced into a negative Vgs regime where Ids decreases exponentially. This improvement is possible because, according to the invention, and unlike the prior art, the gating transistors are low threshold devices.

Third, according to one embodiment of the invention, two types of low threshold transistors are employed; a first type having a threshold voltage of approximately zero volts (0.0 volts) and a second type having a threshold voltage of approximately one hundred and fifty millivolts (150 millivolts). In this embodiment of the invention, the low threshold transistors of the first type, i.e., the Vth1 transistors, are used within the low power device while the low threshold transistors of the second type, i.e., the Vth2 transistors, are used as gating transistors. Since, in this embodiment of the invention, the gating transistors have higher threshold voltages (Vth2) than the device transistors' threshold voltages (Vth1), the gating transistors have lower leakage and provide a gating function to isolate the low power device from the supply voltages. However, since the gating transistors of this embodiment of the invention still have threshold voltages significantly lower than prior art gating transistors, the resulting gated device is still a low power device with decreased active power dissipation and the same performance at a lower supply voltage.

Fourth, in one embodiment of the invention, the low threshold gating transistors are provided with back bias to modulate the threshold voltages of the first and second low threshold gating transistors between an off state and an on-state. The use of back bias is particularly advantageous with embodiments of the invention where low threshold transistors of the second type, i.e., the vth2 transistors discussed above, are used as the gating transistors. This is because, as discussed above, higher threshold voltages means the device exhibits more body effect and more body effect means that back biasing is more effective. In one embodiment of the invention, the low threshold gating transistors are each provided with a separate back bias from a back bias that is provided to the transistors of the device.

The four methods of reducing leakage current using the invention discussed above are by no means mutually exclusive and it is anticipated that they will be used in combination to achieve the desired results. In one embodiment of the invention, all four methods are employed in a single device.

In particular, according to the invention, a method for supply gating an electronic component includes: providing a first supply voltage; providing at least one device; and providing a second supply voltage. A first low threshold gating transistor is coupled between the first supply voltage and the at least one device. A second low threshold gating transistor is coupled between the at least one device and the second supply voltage. In one embodiment, the first and second low threshold gating transistors have an unbiased threshold voltage with a magnitude of about 300 millivolts. The invention includes overdriving the first and second low threshold gating transistors on such that when the first and second low threshold gating transistors are in an on state, a voltage differential between a gate and a source of the first and second low threshold gating transistors is greater than a voltage differential between the first and second supply voltages.

In one embodiment of the invention, the at least one device is a low power device including device transistors and the voltage differential between the first supply voltage and the second supply voltage is less than about 1.0 volt. In this embodiment, the voltage differential between the gate and the source of the first and second low threshold gating transistors when the first and second low threshold gating transistors are overdriven on is less than 2.5 volts.

In one embodiment of the invention, the device transistors have a first unbiased threshold voltage and the low threshold gating transistors have a second unbiased threshold voltage, different from the first unbiased threshold voltage, and the first unbiased threshold voltage is lower than the second unbiased threshold voltage.

In another embodiment of the invention, the at least one device is a low power device including device transistors and the voltage differential between the first supply voltage and the second supply voltage is less than 400 millivolts. In this embodiment, the voltage differential between the gate and the source of the first and second low threshold gating transistors when the first and second low threshold gating transistors are overdriven on is less than 2.5 volts and the first and second low threshold gating transistors each have an unbiased threshold voltage with a magnitude of about 250 millivolts.

In one embodiment of the invention, a method for supply gating an electronic component includes: providing a first supply voltage; providing at least one device; and providing a second supply voltage. A first back biased low threshold gating transistor is coupled between the first supply voltage and the at least one device. A second back biased low threshold gating transistor is coupled between the at least one device and the second supply voltage. The first and second back biased low threshold gating transistors each has an unbiased threshold voltage with a magnitude of about 250 millivolts. In this embodiment, a back bias potential is applied to the first and second back biased low threshold gating transistors to modulate the threshold voltages of the first and second low threshold gating transistors between an off-state and an on-state.

One embodiment of the invention is a method for supply gating an electronic component that includes: providing a first supply voltage; providing at least one device; and providing a second supply voltage. A first low threshold gating transistor is coupled between the first supply voltage and the at least one device. A second low threshold gating transistor is coupled between the at least one device and the second supply voltage. The first and second low threshold gating transistors each have an unbiased threshold voltage having a magnitude of about 250 millivolts. The first and second low threshold gating transistors are overdriven off. In one embodiment of the invention, the at least one device is a low power device including device transistors and the voltage differential between the first supply voltage and the second supply voltage is less than about 1.0 volt. In this embodiment of the invention, the magnitude of voltage differential between the gate and the source of the first and second low threshold gating transistors when the first and second low threshold gating transistors are overdriven off is less than 500 millivolts. In one embodiment of the invention, the device transistors have a first unbiased threshold voltage and the low threshold gating transistors have a second unbiased threshold voltage, different from the first unbiased threshold voltage, wherein the first unbiased threshold voltage is lower than the second unbiased threshold voltage.

In another embodiment of the invention, the at least one device is a low power device including device transistors and the voltage differential between the first supply voltage and the second supply voltage is less than about 400 millivolts. In this embodiment of the invention, the voltage differential between the gate and the source of the first and second low threshold gating transistors when the first and second low threshold gating transistors are overdriven off is less than 200 millivolts and the first and second low threshold gating transistors each have an unbiased threshold voltage having a magnitude of about 250 millivolts.

According to another embodiment of the invention, a method for supply gating an electronic component includes: providing a first supply voltage; providing at least one device; and providing a second supply voltage. A first back biased low threshold gating transistor is coupled between the first supply voltage and the at least one device. A second back biased low threshold gating transistor is coupled between the at least one device and the second supply voltage. In one embodiment, the first and second back biased low threshold gating transistors each have an unbiased threshold voltage with a magnitude of about 250 millivolts. A separate back bias potential is applied to the first and second back biased low threshold gating transistors to modulate a threshold voltage of the first and second low threshold gating transistors between an on and an off state. The first and second back biased low threshold gating transistors are overdriven off.

In another embodiment of the invention, a method for supply gating an electronic component includes: providing a first supply voltage; providing at least one device; and providing a second supply voltage. A first low threshold gating transistor is coupled between the first supply voltage and the at least one device. A second low threshold gating transistor is coupled between the at least one device and the second supply voltage. In one embodiment, the first and second low threshold gating transistors each have an unbiased threshold voltage with a magnitude of about 250 millivolts. The first and second low threshold gating transistors are overdriven on such that when the first and second low threshold gating transistors are in an on state, a voltage differential between a gate and a source of the first and second low threshold gating transistors is greater than a voltage differential between the first and second supply voltages. The first and second low threshold gating transistors are also overdriven off. In one embodiment of the invention, the at least one device is a low power device including device transistors and the voltage differential between the first supply voltage and the second supply voltage is less than about 1.0 volt. In this embodiment, the voltage differential between the gate and the source of the first and second low threshold gating transistors when the first and second low threshold gating transistors are overdriven on is less than 2.5 volts and the voltage differential between the gate and the source of the first and second low threshold gating transistors when the first and second low threshold gating transistors are overdriven off is less than 200 millivolts volts. In one embodiment, the device transistors have a first unbiased threshold voltage and the low threshold gating transistors have a second unbiased threshold voltage, different from the first unbiased threshold voltage, wherein the first unbiased threshold voltage is lower than the second unbiased threshold voltage.

Another embodiment of the invention includes a method for supply gating an electronic component by: providing a first supply voltage; providing at least one device; and providing a second supply voltage. A first back biased low threshold gating transistor is coupled between the first supply voltage and the at least one device. A second back biased low threshold gating transistor is coupled between the at least one device and the second supply voltage. The first and second back biased low threshold gating transistors each have an unbiased threshold voltage with a magnitude of about 200 millivolts and a back bias potential is applied to the first and second back biased low threshold gating transistors to modulate the threshold voltages of the first and second low threshold gating transistors between an off-state and an on-state. The first and second back biased low threshold gating transistors are overdriven on such that when the first and second back biased low threshold gating transistors are in an on state, a voltage differential between a gate and a source of the first and second back biased low threshold gating transistors is greater than a voltage differential between the first and second supply voltages. The first and second low threshold gating transistors are also overdriven off. In one embodiment, the at least one device is a low power device including device transistors and the voltage differential between the first supply voltage and the second supply voltage is less than 250 millivolts. In this embodiment, the voltage differential between the gate and the source of the first and second back biased low threshold gating transistors when the first and second back biased low threshold gating transistors are overdriven on is less than 2.5 volts and the voltage differential between the gate and the source of the first and second back biased low threshold gating transistors when the first and second back biased low threshold gating transistors are overdriven off is less than 0.2 volts. In this embodiment, the first and second low threshold gating transistors each have an unbiased threshold voltage with a magnitude of about 250 millivolts. In one embodiment, the device transistors have a first unbiased threshold voltage and the back biased low threshold gating transistors have a second unbiased threshold voltage, different from the first unbiased threshold voltage, wherein the first unbiased threshold voltage is lower than the second unbiased threshold voltage.

According to the invention, the low threshold gating transistors can be overdriven on so that the resistance added by including gating transistors is minimized and device performance is enhanced. This is in contrast to the prior art gating transistors that added significant resistance and decreased performance in terms of decreased device speed. In one embodiment of the invention, the performance enhancement of the present invention is obtained, in contrast to the prior art, without increasing the size of the gating transistors relative to the size of the transistors making up the device. In addition, if even less resistance is desired, according to the invention, the size of gating transistors of the invention can be increased and the transistor can still be overdriven on according to the invention. Therefore, the invention can provide the advantages of supply gating without the large performance penalty associated with the prior art.

In addition, the gating transistors of the invention can be overdriven off. By overdriving the gating transistors of the invention off, the transistor can be forced into an off condition where the leakage current is optimized.

In addition, according to one embodiment of the invention, low threshold transistors of a first type are used within the low power device while the low threshold transistors of the second type are used as gating transistors. Since, in this embodiment of the invention, the gating transistors have higher threshold voltages than the device transistors, the gating transistors have lower leakage and provide a gating function to isolate the low power device from the supply voltages.

In one embodiment of the invention, the low threshold gating transistors are provided with back bias to modulate the threshold voltages of the first and second low threshold gating transistors between an off state and an on-state. The use of back bias is particularly advantageous with embodiments of the invention where low threshold transistors of the second type, discussed above, are used as the gating transistors. This is because, as discussed above, a higher threshold voltage means the transistor exhibits more body effect and more body effect means that back biasing is more effective.

Consequently, using the method and apparatus of the invention, the power dissipation of a device in standby mode is decoupled from leakage current by using circuitry to control the leakage current in low threshold transistors and devices. Therefore, using the invention, the threshold voltage of a device is lowered and the active power dissipation is decreased by permitting the same performance to be achieved at a lower supply voltage. However, using the invention, the increase in device leakage current and standby power dissipation typically associated with lowered threshold voltage of a device is avoided.

It is to be understood that both the foregoing general description and following detailed description are intended only to exemplify and explain the invention as claimed.

BRIEF DESCRIPTION OF THE DRAWINGS

The accompanying drawings, which are incorporated in, and constitute a part of this specification, illustrate embodiments of the invention and, together with the description, serve to explain the advantages and principles of the invention. In the drawings.

DETAILED DESCRIPTION

The invention will now be described in reference to the accompanying drawings. The same reference numbers may be used throughout the drawings and the following description to refer to the same or like parts.

Figure 4A:
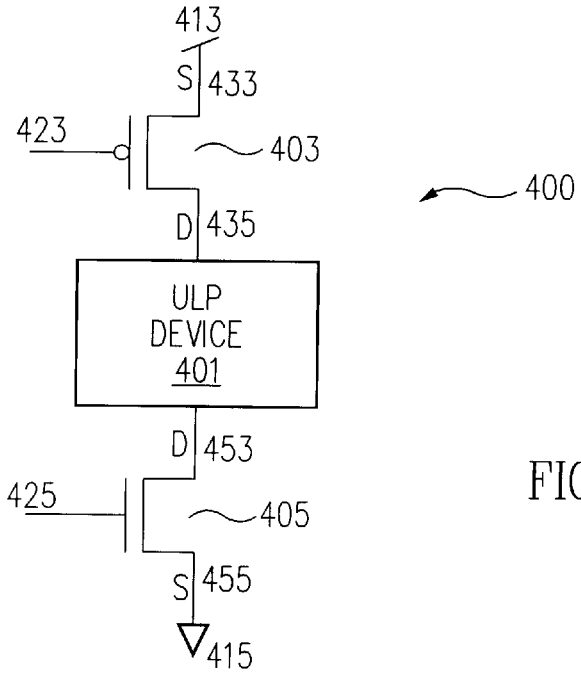
FIG. 4A shows a schematic representation of a low power supply gated component in accordance with one embodiment of the invention.
Figure 5:
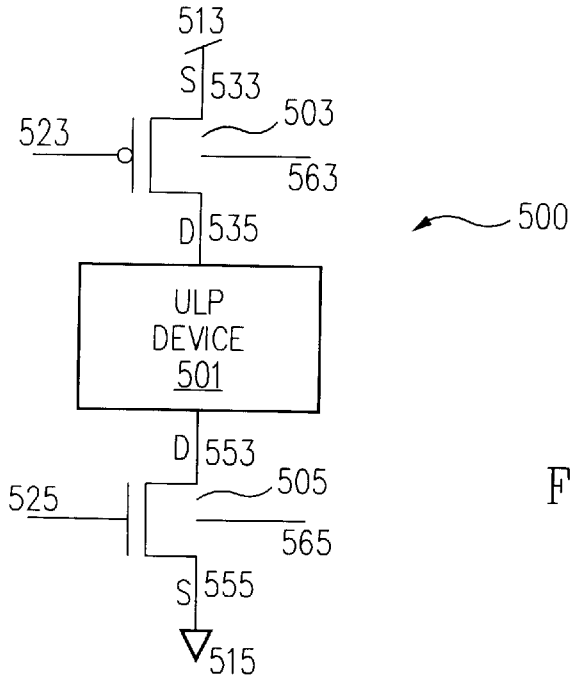
FIG. 5 shows a schematic representation of a low power supply gated component in accordance with another embodiment of the invention.
Figure 7:
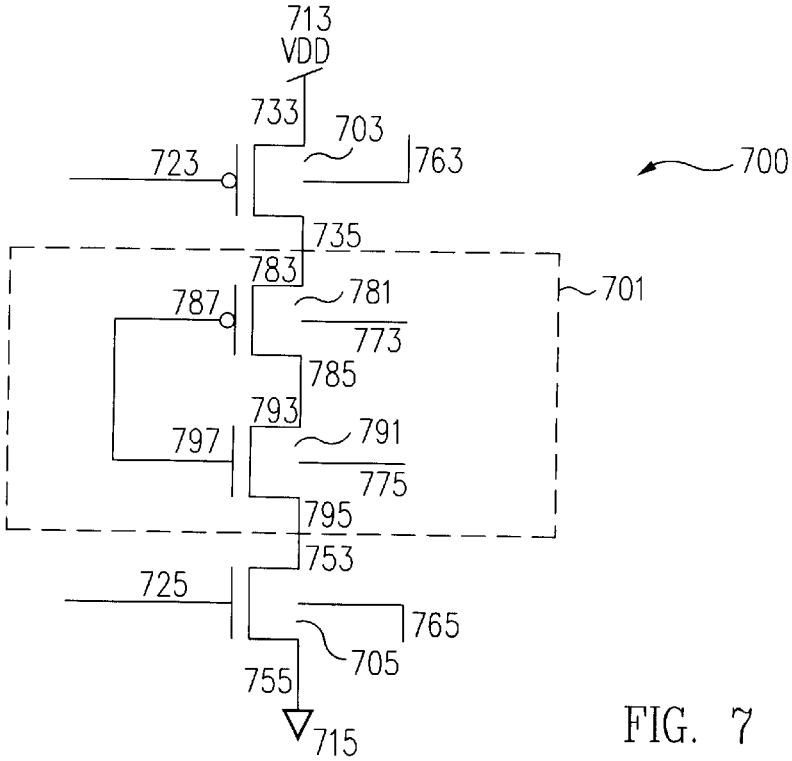
FIG. 7 shows a low power supply gated component that includes a device that is an inverter in accordance with one embodiment of the invention.
Figure 8A:
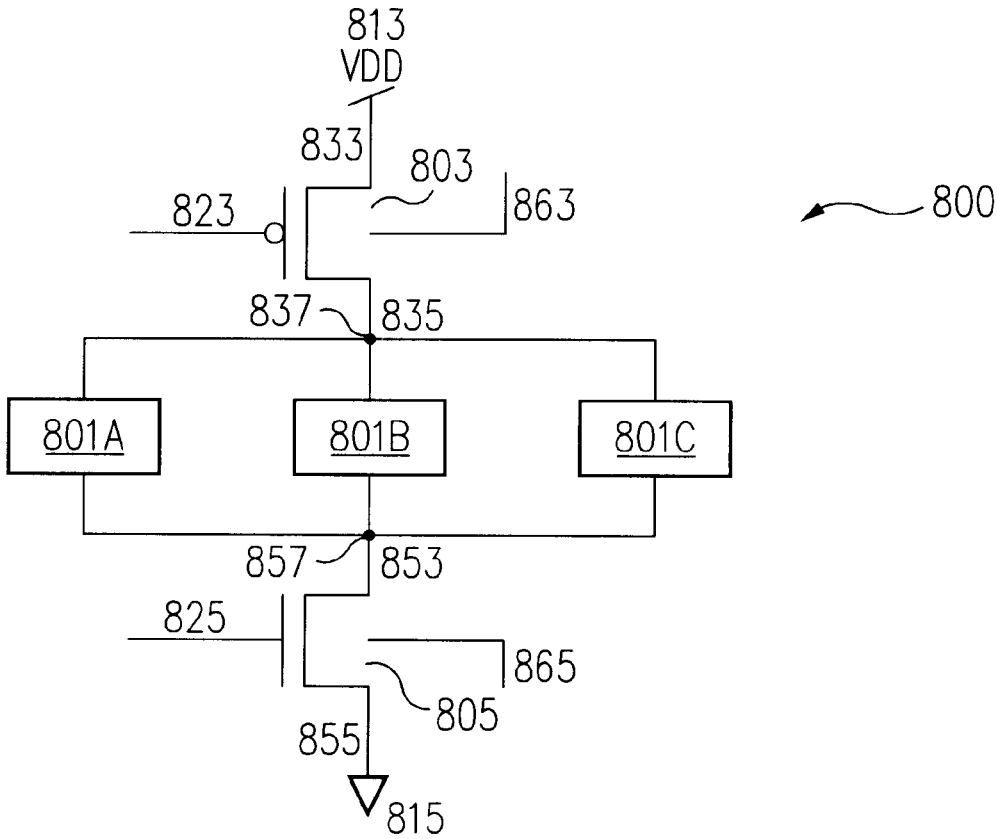
FIG. 8A shows a schematic representation of a low power supply gated network in accordance with one embodiment of the invention.
Figure 8B:
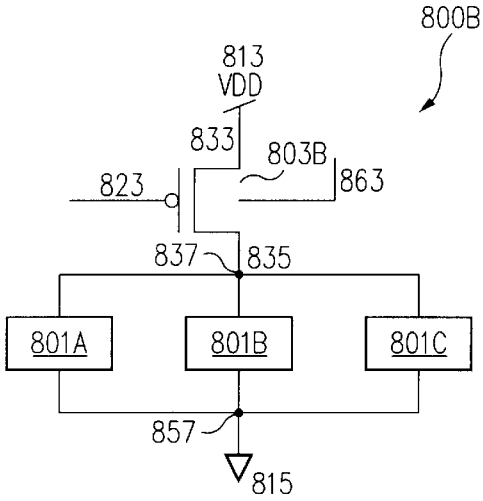
FIG. 8B shows a schematic representation of a low power supply gated network in accordance with one embodiment of the invention.
Figure 8C:
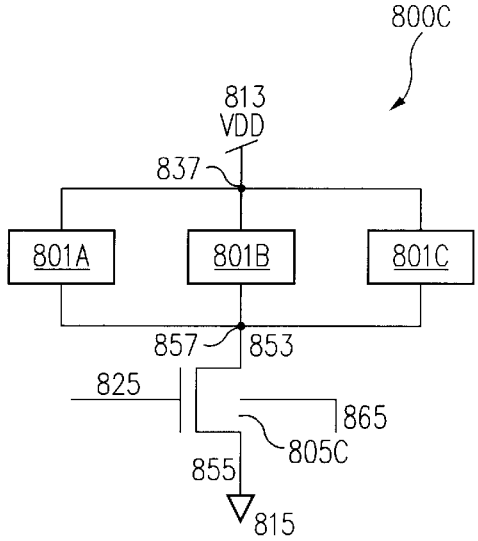
FIG. 8C shows a schematic representation of a low power supply gated network in accordance with one embodiment of the invention.
Figure 8D:
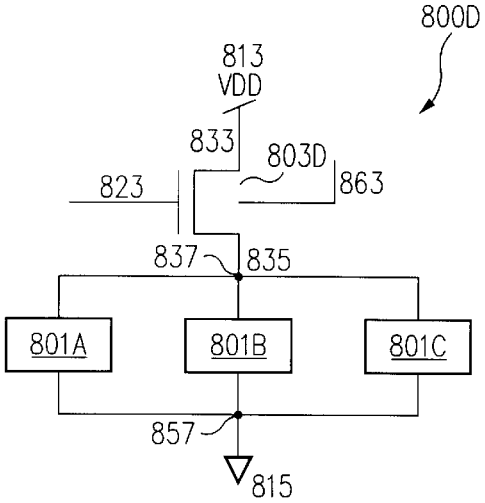
FIG. 8D shows a schematic representation of a low power supply gated component in accordance with one embodiment of the invention.
Figure 8E:
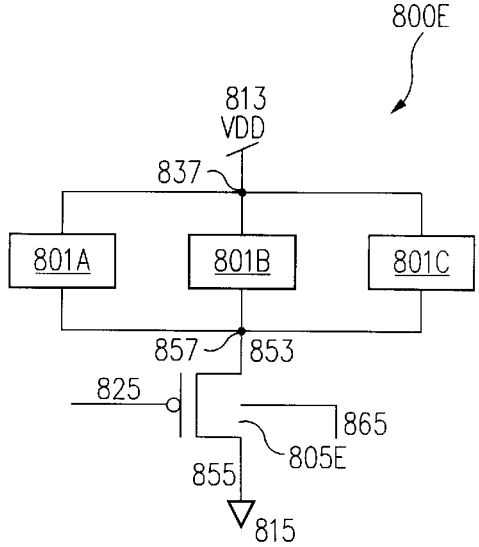
FIG. 8E shows a schematic representation of a low power supply gated component in accordance with one embodiment of the invention.
Figure 9:
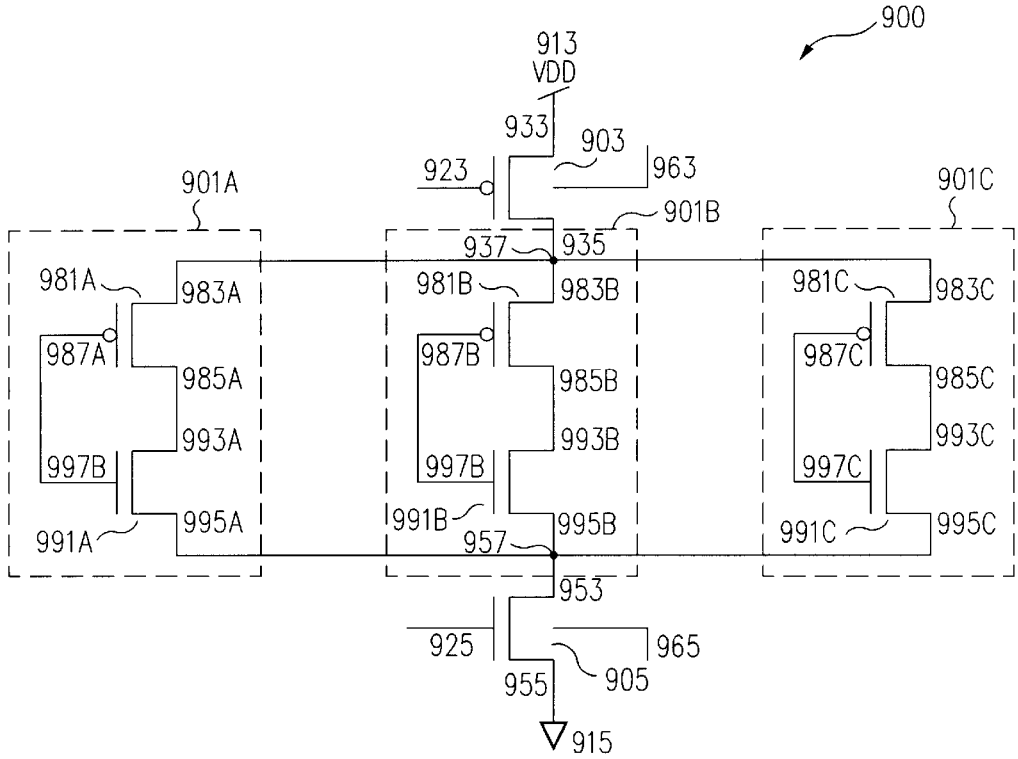
FIG. 9 shows a low power supply gated network that includes devices that are inverters in accordance with one embodiment of the invention.

The present invention provides low power supply gated components (400 in FIG. 4, 500 in FIG. 5, 700 in FIG. 7, 800 in FIG. 8 and 900 in FIG. 9). According to the invention, low power devices (401 in FIG. 4, 501 in FIG. 5, 701 in FIG. 7, 801A, 801B and 801C in FIG. 8 and 901A, 901B and 901C in FIG. 9) are provided with low threshold gating transistors (403 and 405 in FIG. 4, 503 and 505 in FIG. 5, 703 and 705 in FIG. 7, 803 and 805 in FIG. 8 and 903 and 905 in FIG. 9). According to the invention, the low power devices operate at supply voltages of less than one volt and typically in the range of 150 to 400 millivolts. Using low threshold gating transistors according to the invention, the leakage current of the devices, and therefore the standby power dissipation, can be minimized by using any one, or a combination of, four methods.

First, since the devices of the invention are low power, the supply voltages (413 and 415 in FIG. 4, 513 and 515 in FIG. 5, 713 and 715 in FIG. 7, 813 and 815 in FIG. 8 and 913 and 915 in FIG. 9) are low, and the threshold voltages of the gating transistors are low, the gating transistors of the invention can be overdriven on, i.e., provided gate to source voltages (Vgs) significantly larger than the device supply voltage without causing the destruction of the gating transistor. For instance, in one embodiment of the invention, the device supply voltage is 200 millivolts while the Vgs is on the order of 2.0 volts. This is in direct contrast to prior art gating transistors that had to be driven at essentially the same Vgs as the supply voltage to avoid transistor breakdown. By overdriving the gating transistors of the invention, the resistance added to the device by the gating transistors is decreased significantly without resorting to increasing the size of the transistor, as was done in the prior art. In addition, if even less resistance is desired, the size of gating transistors of the invention can be increased and the transistor can still be overdriven according to the invention. Consequently, using the invention, there is an approach for resistance reduction available that was not available in the prior art and can provide orders of magnitude decrease in the added resistance. Therefore, the invention can provide the advantages of supply gating without the large performance penalty associated with the prior art.

Second, the gating transistors of the invention can be overdriven off by providing gate to source voltages (Vgs) of less than 300 millivolts. By overdriving the gating transistors of the invention off the transistor can be forced into an off condition where the leakage current is minimized. For instance, using an NFET low threshold gating transistor, Vgs can be made negative so that the drain to source current (Ids) is forced into a negative Vgs regime where Ids decreases exponentially. This improvement is possible only because, according to the invention, and unlike the prior art, the gating transistors are low threshold devices.

Third, according to one embodiment of the invention, two types of low threshold transistors are employed; a first type having a very low threshold voltage (Vth1) of approximately zero volts (0.0 volts) and a second type having a low threshold voltage (Vth2) of approximately one hundred and fifty millivolts (150 millivolts). In this embodiment of the invention, the very low threshold transistors of the first type, i.e., the Vth1 transistors, are used within the low power device while the low threshold transistors of the second type, i.e., the Vth2 transistors, are used as gating transistors. Since, in this embodiment of the invention, the gating transistors have higher threshold voltages (Vth2) than the device transistors threshold voltages (Vth1), the gating transistors have lower leakage and provide a gating function to isolate the low power device from the supply voltages. However, since the gating transistors of this embodiment of the invention still have threshold voltages significantly lower than prior art gating transistors, the resulting gated device is still a low power device with decreased active power dissipation and the same performance at a lower supply voltage.

Fourth, in one embodiment of the invention, the low threshold gating transistors are provided with back bias (563 and 565 in FIG. 5, 763 and 765 in FIG. 7, 863 and 865 in FIG. 8 and 963 and 965 in FIG. 9) to modulate the threshold voltages of the first and second low threshold gating transistors between an off state and an on-state. The use of back bias is particularly advantageous with embodiments of the invention where low threshold transistors of the second type, i.e., the Vth2 transistors discussed above, are used as the gating transistors. This is because, as discussed above, relatively higher threshold voltages means the transistor exhibits more body effect and more body effect means that back biasing is more effective. In one embodiment of the invention, the low threshold gating transistors are each provided with a separate back bias from a back bias (773 and 775 in FIG. 7) provided to the transistors of the device.

The four methods of reducing leakage current using the invention discussed above are by no means mutually exclusive and it is anticipated that they will be used in combination to achieve the desired results. In one embodiment of the invention, all four methods are employed in a single device.

FIG. 4A shows a schematic representation of a low power supply gated component 400 in accordance with one embodiment of the invention. Low power supply gated component 400 includes a device 401, a first low threshold gate transistor 403, coupled between first supply voltage 413 and device 401, and a second low threshold gate transistor 405, coupled between device 401 and a second supply voltage 415. Device 401 could be any one of numerous devices well known to those of skill in the art such as a transistor, an inverter, a latch, or any one of several logic or memory gates, or any other logic or memory device. In one embodiment of the invention, device 401 is a low power device having a supply voltage of less than one volt (1.0 volt), and typically between one hundred fifty and four hundred millivolts (0.15 and 0.4 volts).

In low power supply gated component 400, first low threshold gate transistor 403 is a PFET and includes: a source 433 coupled to first supply voltage 413; a gate 423 coupled to a control voltage source (not shown); and a drain 435 coupled to device 401. Likewise, second low threshold gate transistor 405 is an NFET and includes: a drain 453 coupled to device 401, a gate 425 coupled to a control voltage source (not shown) and a source 455 coupled to second supply voltage 415. In one embodiment of the invention, first supply voltage 413 is positive and less than one volt (1.0 volt) and typically between one hundred fifty and four hundred millivolts (0.15 and 0.4 volts). In this embodiment, second supply voltage 415 is ground.

In FIG. 4A, a low power supply gated component 400 is shown that includes first low threshold gate transistor 403 that is a PFET and second low threshold gate transistor 405 that is an NFET. However, those of skill in the art will readily recognize that this particular embodiment is shown only as an illustrative example and that in other embodiments, other combinations of PFETs and NFETs could also be used. Consequently, the particular embodiment discussed is chosen only to simplify the following discussion and avoid detracting from the invention by addressing multiple possible embodiments at one time.

The addition of low threshold gating transistors 403 and 405 to device 401 helps control leakage current by providing a capability to isolate device 401 from first supply voltage 413 and second supply voltage 415. This capability is provided by using low threshold gating transistors 403 and 405 as switches controlled by the control voltages supplied to gates 423 and 425 of low threshold gating transistors 403 and 405, respectively.

According to the invention, low power supply gated component 400 is low power, and the differential between supply voltages 413 and 415 is low. Consequently, low threshold gating transistors 403 and 405 can be overdriven on, i.e., provided gate (423, 425) to source (433, 455) voltages (Vgs) significantly larger than the differential between supply voltages 413 and 415 without causing the destruction of gating transistors 403 and 405. For instance, in one embodiment of the invention, first supply voltage 413 is 200 millivolts and second supply voltage 415 is ground, yielding a differential of 200 millivolts, while the Vgs is on the order of 2.0 volts. This is in direct contrast to prior art gating transistors that had to be driven at essentially the same Vgs as the supply voltage to avoid transistor breakdown. By overdriving low threshold gating transistors 403 and 405 of the invention, the resistance added to low power supply gated component 400 by gating transistors 403 and 405 is decreased significantly without resorting to increasing the size of transistors 403 and 405, as was done in the prior art.

In addition, if even less resistance is desired, the size of gating transistors 403 and 405 of the invention can be increased and transistors 403 and 405 can still be overdriven according to the invention. Consequently, using the invention, there is an approach for resistance reduction available that was not available in the prior art and can provide orders of magnitude decrease in added resistance. Therefore, the invention can provide the advantages of supply gating without the large performance penalty associated with the prior art.

In addition, since the threshold voltages of the supply gating transistors 403 and 405 of the invention are so low, supply gating transistors 403 and 405 of the invention can be overdriven off, by providing gate (423, 425) to source (433, 455) voltages (Vgs) of less than 300 millivolts, to further decrease leakage. A negative gate voltage of as little as −200 millivolts can reduce leakage by three orders of magnitude or more. By overdriving gating transistors 403 and 405 of the invention off, low threshold gating transistors 403 and 405 can be forced into an off condition where the leakage current is optimized. For instance, using NFET low threshold gating transistor 405 as an example, Vgs can be made negative so that the source 455 to drain 453 current (Ids) is forced into a negative Vgs regime (portions 319 and 321 of curve 310 in FIG. 3) where Ids decreases exponentially or is minimum. This improvement is possible because, according to the invention, and unlike the prior art, low threshold gating transistors 403 and 405 are low threshold transistors.

Figure 4B:
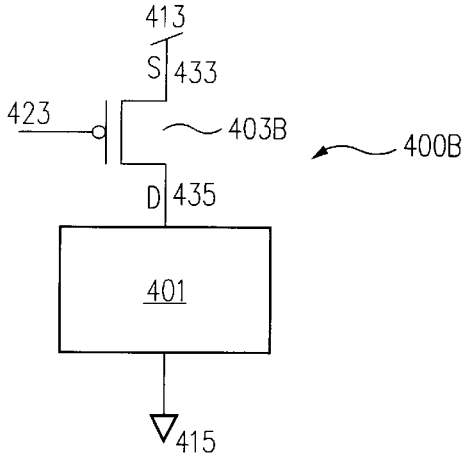
FIG. 4B shows a schematic representation of a low power supply gated component in accordance with one embodiment of the invention.

FIG. 4B shows a schematic representation of a low power supply gated component 400B, in accordance with one embodiment of the invention, that is a variation of low power supply gated component 400 discussed above. Low power supply gated component 400B includes a device 401, a second supply voltage 415 and a single low threshold gate transistor 403B, coupled between first supply voltage 413 and device 401. Device 401 could be any one of numerous devices well known to those of skill in the art such as a single transistor, an inverter, a latch, any one of several logic or memory gates, or any other logic or memory device. In one embodiment of the invention, device 401 is a low power device having a supply voltage of less than one volt (1.0 volt), and typically between one hundred fifty and four hundred millivolts (0.15 and 0.4 volts).

In low power supply gated component 400B, single low threshold gate transistor 403B is a PFET and includes: a source 433 coupled to first supply voltage 413; a gate 423 coupled to a control voltage source (not shown); and a drain 435 coupled to device 401. In one embodiment of the invention, first supply voltage 413 is positive and less than one volt (1.0 volt) and typically between one hundred fifty and four hundred millivolts (0.15 and 0.4 volts). In this embodiment, second supply voltage 415 is ground.

Figure 4C:
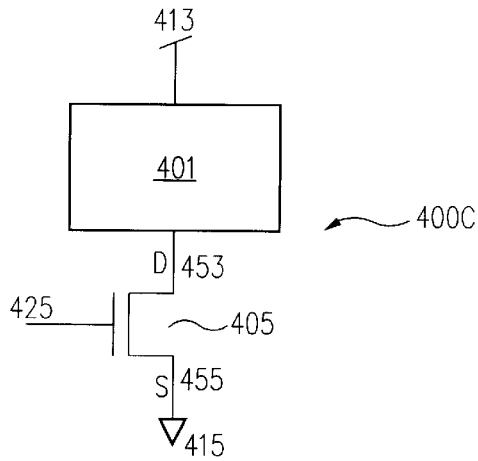
FIG. 4C shows a schematic representation of a low power supply gated component in accordance with one embodiment of the invention.

FIG. 4C shows a schematic representation of a low power supply gated component 400C, in accordance with one embodiment of the invention, that is a variation of low power supply gated component 400 discussed above. Low power supply gated component 400C includes a device 401 and a single low threshold gate transistor 405C, coupled between device 401 and a second supply voltage 415. Device 401 could be any one of numerous devices well known to those of skill in the art such as a single transistor, an inverter, a latch, any one of several gates, or any other logic or memory device. In one embodiment of the invention, device 401 is a low power device having a supply voltage of less than one volt (1.0 volt), and typically between one hundred fifty and four hundred millivolts (0.15 and 0.4 volts).

In low power supply gated component 400C, single low threshold gate transistor 405C is an NFET and includes: a drain 453 coupled to device 401, a gate 425 coupled to a control voltage source (not shown) and a source 455 coupled to second supply voltage 415. In one embodiment of the invention, first supply voltage 413 is positive and less than one volt (1.0 volt) and typically between one hundred fifty and four hundred millivolts (0.15 and 0.4 volts). In this embodiment, second supply voltage 415 is ground.

Low power supply gated components 400B and 400C have the advantages of the invention discussed above, and any combination of the methods of the present invention can be practiced on these structures. For instance, single low threshold gate transistors 405B and 405C can be overdriven as discussed above and their channel dimensions can be optimized as discussed above with the same positive results.

Figure 4D:
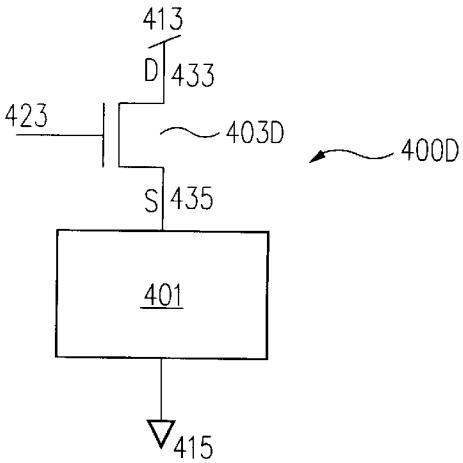
FIG. 4D shows a schematic representation of a low power supply gated component in accordance with one embodiment of the invention.

FIG. 4D shows a schematic representation of a low power supply gated component 400D, in accordance with one embodiment of the invention, that is a variation of low power supply gated component 400 discussed above. Low power supply gated component 400D includes a first supply voltage 413, a device 401, a second supply voltage 415 and a single low threshold gate transistor 403D, coupled between first supply voltage 413 and device 401. Device 401 could be any one of numerous devices well known to those of skill in the art such as a transistor, an inverter, a latch, or any one of several logic or memory gates, or any other logic or memory device. In one embodiment of the invention, device 401 is a low power device having a supply voltage of less than one volt (1.0 volt), and typically between one hundred fifty and four hundred millivolts (0.15 and 0.4 volts).

In low power supply gated component 400D, single low threshold gate transistor 403D is a NFET and includes: a drain 433 coupled to first supply voltage 413; a gate 423 coupled to a control voltage source (not shown); and a source 435 coupled to device 401. In one embodiment of the invention, first supply voltage 413 is positive and less than one volt (1.0 volt) and typically between one hundred fifty and four hundred millivolts (0.15 and 0.4 volts). In this embodiment, second supply voltage 415 is ground.

The fact that low power supply gated component 400D includes single low threshold gate transistor 403D that is an NFET, and is coupled between first supply voltage 413 and device 401, is unique and is made practical only through the methods and structure of the invention. In the prior art, the use of an NFET as single low threshold gate transistor 403D would be impractical because, exchanging NFETS and PFETS in the prior art severely degraded performance and was of extremely limited value. This was a result of the fact that with higher threshold voltages, and larger body effect, prior art NFETS passed digital lows or "0" efficiently but did not pass digital highs or "1" well. Similarly, prior art PFETs passed digital highs or "1" efficiently but did not pass digital lows or "0" well. However, according to the invention, the supply gate transistors can be overdriven as described above. Consequently, supply gate NFETs of the invention can pass both digital highs or "1" and digital lows or "0" well and supply gate PFETs of the invention can pass both digital lows or "0" and digital highs or "1" well. Therefore, using the method and structure of the invention, and in contrast to the prior art, low power supply gated component 400D can include a single low threshold gate transistor 403D that is an NFET and still operate efficiently.

Figure 4E:
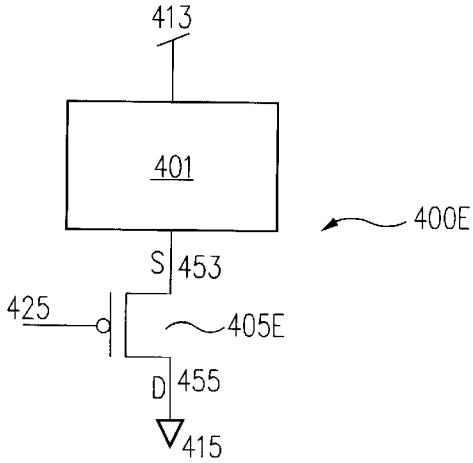
FIG. 4E shows a schematic representation of a low power supply gated component in accordance with one embodiment of the invention.

FIG. 4E shows a schematic representation of a low power supply gated component 400E, in accordance with one embodiment of the invention, that is a variation of low power supply gated component 400 discussed above. Low power supply gated component 400E includes a device 401 and a single low threshold gate transistor 405E, coupled between device 401 and a second supply voltage 415. Device 401 could be any one of numerous devices well known to those of skill in the art such as a single transistor, an inverter, a latch, any one of several gates, or any other logic or memory device. In one embodiment of the invention, device 401 is a low power device having a supply voltage of less than one volt (1.0 volt), and typically between one hundred fifty and four hundred millivolts (0.15 and 0.4 volts).

In low power supply gated component 400E, single low threshold gate transistor 405E is a PFET and includes: a source 453 coupled to device 401, a gate 425 coupled to a control voltage source (not shown) and a drain 455 coupled to second supply voltage 415. In one embodiment of the invention, first supply voltage 413 is positive and less than one volt (1.0 volt) and typically between one hundred fifty and four hundred millivolts (0.15 and 0.4 volts). In this embodiment, second supply voltage 415 is ground.

The fact that low power supply gated component 400E includes single low threshold gate transistor 403E that is a PFET, and is coupled between device 401 and second supply voltage 415, is unique and is made practical only through the methods and structure of the invention. In the prior art, the use of a PFET as single low threshold gate transistor 403E would be impractical because, exchanging NFETS and PFETS in the prior art severely degraded performance and was of extremely limited value. This was a result of the fact that with higher threshold voltages, and larger body effect, prior art NFETS passed digital lows or "0" efficiently but did not pass digital highs or "1" well. Similarly, prior art PFETs passed digital highs or "1" efficiently but did not pass digital lows or "0" well. However, according to the invention, the supply gate transistors can be overdriven as described above. Consequently, supply gate NFETs of the invention can pass both digital highs or "1" and digital lows or "0" well and supply gate PFETs of the invention can pass both digital lows or "0" and digital highs or "1" well. Therefore, using the method and structure of the invention, and in contrast to the prior art low power supply gated component 400E can include a single low threshold gate transistor 403E that is a PFET and still operate efficiently.

Low power supply gated components 400D and 400E have all the advantages of the invention discussed above and any combination of the methods of the present invention can be practiced on these structures. For instance, single low threshold gate transistors 405D and 405E can be overdriven as discussed above and their channel dimensions can be optimized as discussed above with the same positive results.

FIG. 5 shows a schematic representation of a low power supply gated component 500 in accordance with one embodiment of the invention. Low power supply gated component 500 includes a device 501, a first back biased low threshold gate transistor 503, coupled between first supply voltage 513 and device 501, and a second back biased low threshold gate transistor 505, coupled between device 501 and a second supply voltage 515. As with device 401 discussed above, device 501 could be any one of numerous devices well known to those of skill in the art such as a single transistor, an inverter, a latch, any one of several logic or memory gates, or any other logic of memory device. In one embodiment of the invention, device 501 is a low power device having a supply voltage of less than one volt (1.0 volt) and typically between one hundred fifty and four hundred millivolts (0.15 and 0.4 volts).

In low power supply gated component 500, first back biased low threshold gate transistor 503 is a PFET and includes: a source 533 coupled to first supply voltage 513; a gate 523 coupled to a control voltage source (not shown); and a drain 535 coupled to device 501. Likewise, second back biased low threshold gate transistor 505 is an NFET and includes: a drain 553 coupled to device 501, a gate 525 coupled to a control voltage source (not shown) and a source 555 coupled to second supply voltage 515. In one embodiment of the invention, first supply voltage 513 is positive and less than one volt (1.0 volt), and typically between one hundred fifty and four hundred millivolts (0.15 and 0.4 volts). In this embodiment, second supply voltage 515 is ground.

Low power supply gated component 500 is similar to low power supply gated component 400, discussed above, and has all the advantages discussed above with respect to low power supply gated component 400, including the ability to overdrive on and overdrive off back biased low threshold gating transistors 503 and 505. In addition, low power supply gated component 500 includes back biased low threshold gating transistors 503 and 505 that include back biased terminals 563 and 565 and therefore can be back biased by providing bias voltages to back bias terminals 563 and 565.

As discussed above, back biasing provides a mechanism to modulate the threshold voltages of the first and second low threshold gating transistors 503 and 505 between an off state and an on state. For example, a supply gate NFET could be biased to +500 millivolts when on, thereby lowering its threshold voltage to −100 millivolts. The supply gate NFET could also be biased to −3.0 volts when off, thereby raising its threshold voltage to +300 millivolts and reducing leakage by five orders of magnitude; from 10 microamps per micron to 100 picoamps per micron.

Figure 1A:
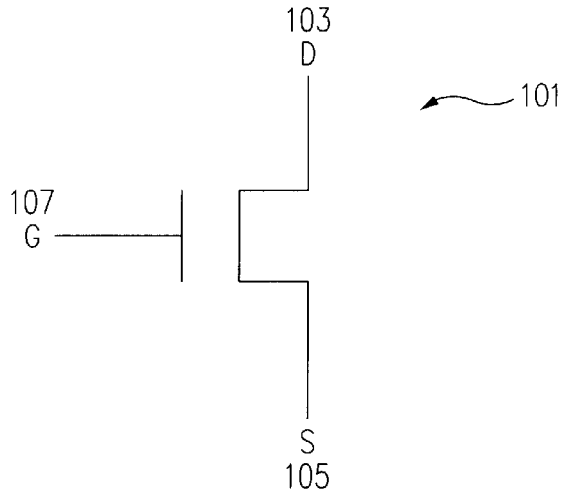
FIG. 1A (PRIOR ART)
FIG. 1A is a schematic representation of a typical transistor having a drain, a source and a gate.
Figure 1B:
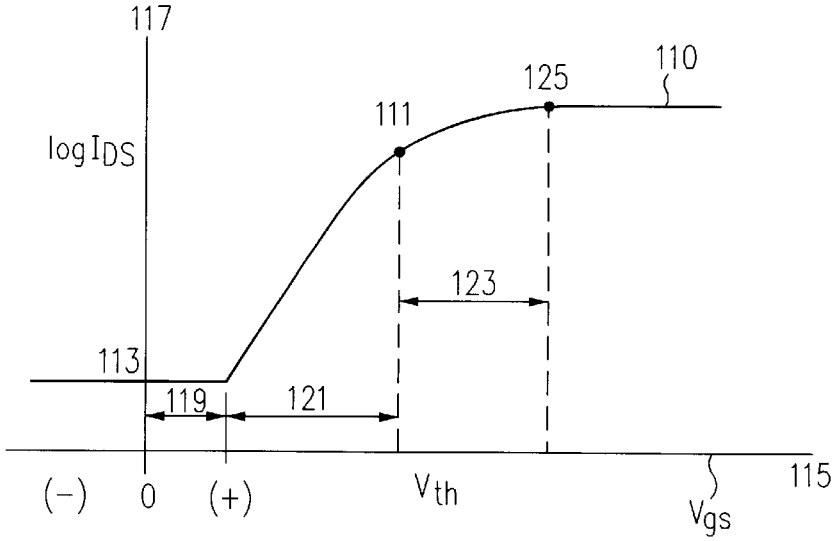
FIG. 1B (PRIOR ART)
FIG. 1B graphically represents the voltage between the gate and the source (Vgs), on the horizontal axis, versus the log of the current between the drain and the source (Ids), on the vertical axis, for a typical prior art standard CMOS NFET.
Figure 2:
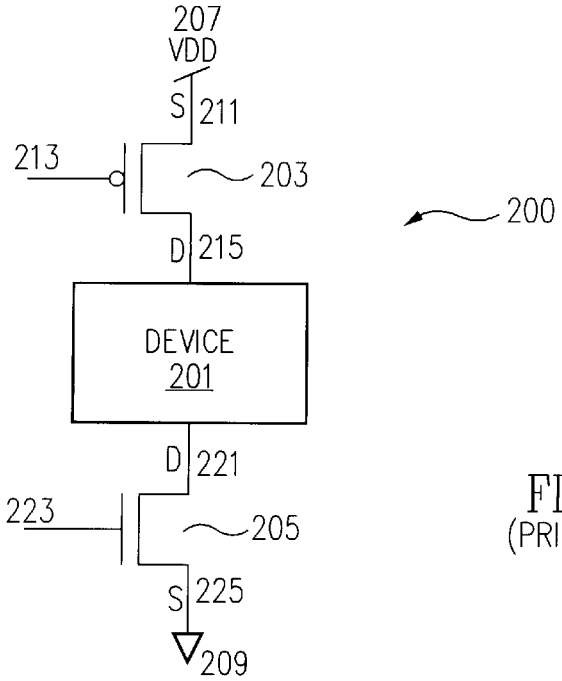
FIG. 2 (PRIOR ART)
FIG. 2 shows a prior art supply gated component including a device, a first prior art gate transistor coupled between a first supply voltage and the device, and a second prior art gate transistor coupled between the device and a second supply voltage.
Figure 3:
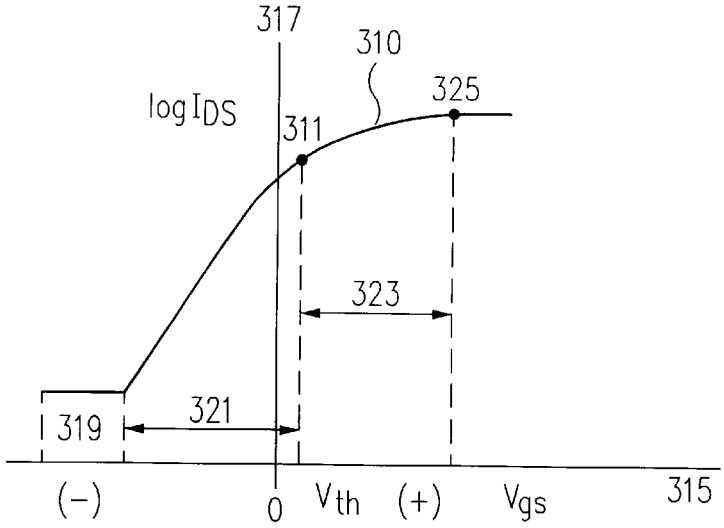
FIG. 3 (PRIOR ART)
FIG. 3 graphically represents the voltage between the gate and the source (Vgs), on the horizontal axis, versus the log of the current between the drain and the source (Ids), on the vertical axis, for a typical low threshold NFET.
Figure 6:
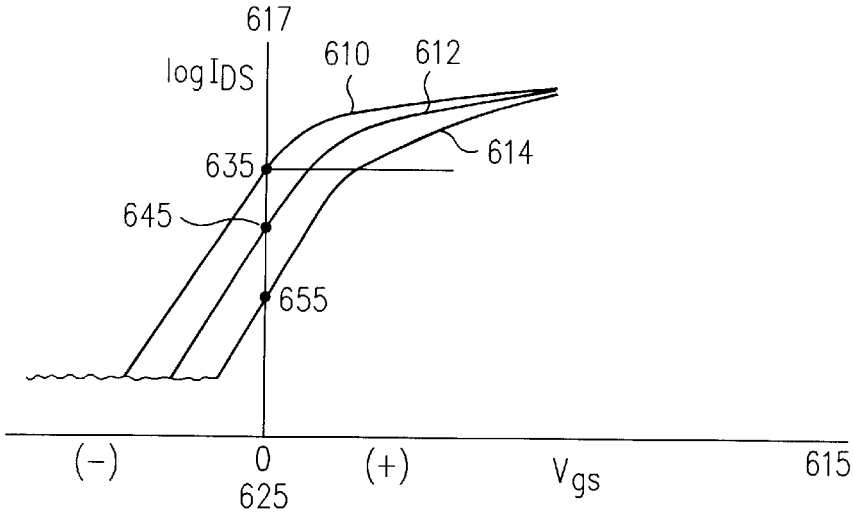
FIG. 6 shows the effects back biasing has on the threshold voltages and the performance of a low threshold gating transistor in accordance with the invention.

FIG. 6 shows the effects back biasing has on the threshold voltages and performance of a low threshold gating transistor. Using back biased low threshold gating transistor 505 as an example, FIG. 6 graphically represents the curves 610, 612 and 614 of the voltage between gate 525 and source 555 (Vgs), on the horizontal axis 615, versus the log of the current between drain 553 and source 555 (Ids), on the vertical axis 617. Curve 610 represents the performance of back biased low threshold gating transistor 505 without any back bias potential applied. Note that curve 610 is virtually identical to curve 310 in FIG. 3 and has substantially the same shape as curve 110 for a standard CMOS NFET transistor shown in FIG. 1A. However, curve 610 in FIG. 6, like curve 310 in FIG. 3, is essentially shifted to the left as a result of lowering the threshold voltage of the device.

As seen in FIG. 6, when Vgs is approximately zero volts, point 625 on horizontal axis 615, curve 610 intersects vertical axis 617 at point 635. Consequently, point 635 shows the leakage current at Vgs=0 on curve 610. Curve 612 shows the performance of back biased low threshold gating transistor 505 with a first level of back bias applied. When Vgs is approximately zero volts, point 625 on horizontal axis 615, curve 612 intersects vertical axis 617 at point 645. Consequently, point 645 shows the leakage current at Vgs=0 on curve 612. Note that point 645 represents a lower leakage current than point 635. Curve 614 shows the performance of back biased low threshold gating transistor 505 with a second, higher, level of back bias applied. When Vgs is approximately zero volts, point 625 on horizontal axis 615, curve 614 intersects vertical axis 617 at point 655. Consequently, point 655 shows the leakage current at Vgs=0 on curve 614. Note that point 655 represents a lower leakage current than points 635 or 645. Those of skill in the art will recognize that appropriate back biasing would have similar effects on back biased low threshold gating transistor 503 and that back biased low threshold gating transistor 505 was chosen as an example to simplify the discussion and avoid detracting from the invention.

As discussed above, devices 401 and 501 can be any one of, or combination of, well-known devices such as transistors, inverters, latches, logic gates and logic or memory devices. FIG. 7 shows a low power supply gated component 700 that includes a device 701 that is an inverter.

Low power supply gated component 700 includes inverter 701; a first back biased low threshold gate transistor 703 coupled between first supply voltage 713 and inverter 701, and a second back biased low threshold gate transistor 705 coupled between inverter 701 and a second supply voltage 715. Inverter 701 includes a first inverter transistor 781 and a second inverter transistor 791. In one embodiment of the invention, inverter 701 is a low power inverter having a supply voltage of less than one volt (1.0 volt) and typically between one hundred fifty and four hundred millivolts (0.15 and 0.4 volts). In this embodiment, inverter transistors 781 and 791 are also low power and either low threshold or very low threshold transistors.

In low power supply gated component 700, first back biased low threshold gate transistor 703 is a PFET and includes: a source 733 coupled to first supply voltage 713; a gate 723 coupled to a control voltage source (not shown); and a drain 735 coupled to a source 783 of inverter transistor 781. Likewise, second back biased low threshold gate transistor 705 is an NFET and includes: a drain 753 coupled to a source 795 of inverter transistor 791, a gate 725 coupled to a control voltage source (not shown) and a source 755 coupled to second supply voltage 715. In addition, inverter transistor 781 includes a gate 787 that is coupled to a gate 797 of inverter transistor 791. In one embodiment of the invention, first supply voltage 713 is positive and less than one volt (1.0 volt) and typically between one hundred fifty and four hundred millivolts (0.15 and 0.4 volts). In this embodiment, second supply voltage 715 is ground.

Low power supply gated component 700 is similar to low power supply gated component 500 discussed above and has all the advantages discussed above with respect to low power supply gated component 500, including the ability to overdrive on and overdrive off back biased low threshold gating transistors 703 and 705 and/or a back biasing capability. In low power supply gated component 700, back biasing is accomplished using low threshold gating transistors 703 and 705 that include back bias terminals 763 and 765 and by providing bias voltages to back bias terminals 763 and 765. In addition, in one embodiment of the invention, inverter transistors 781 and 791 also include back bias terminals 773 and 775, respectively, and therefore inverter transistors 781 and 791 can be back biased by providing bias voltages to back bias terminals 773 and 775. In one embodiment of the invention, threshold gating transistors 703 and 705 and inverter transistors 781 and 791 are identically back biased by the same voltage sources. In another embodiment of the invention, threshold gating transistors 703 and 705 and inverter transistors 781 and 791 are each separately back biased by different voltage sources.

In addition, according to one embodiment of the invention, two types of low threshold transistors are employed in low power supply gated components 400, 500 and 700; a first type having a very low threshold voltage (Vth1) of approximately zero volts (0.0 volts) and a second type having a low threshold voltage (Vth2) of approximately one hundred and fifty millivolts (150 millivolts).

Using the embodiment of the invention shown in FIG. 7 as an example, the very low threshold transistors of the first type, i.e., the Vth1 transistors, are used within inverter 701, i.e., as inverter transistors 781 and 791 while the low threshold transistors of the second type, i.e., the Vth2 transistors, are used as low threshold gating transistors 703 and 705. Since, in this embodiment of the invention, low threshold gating transistors 703 and 705 have higher threshold voltages (Vth2) than inverter transistors 781 and 791, low threshold gating transistors 703 and 705 have lower leakage and provide a gating function to isolate inverter 701 from the supply voltages 713 and 715.

As noted above, two types of low threshold transistors can be employed in each embodiment of the invention and this method is not limited to use with the embodiment of the invention shown in FIG. 7. Indeed the methods of reducing leakage current using the invention discussed above are by no means mutually exclusive and it is anticipated that they will be used in combination to achieve the desired results. In one embodiment of the invention, all four methods are employed in a single device.

In addition, the present invention can be used in systems and networks that include more than one device, such as devices 401, 501, and 701. FIG. 8A shows a schematic representation of a low power supply gated network 800 in accordance with one embodiment of the invention. Low power supply gated network 800 includes: devices 801A, 801B and 801C; a first network node 837 that is coupled to devices 801A, 801B and 801C; a first back biased low threshold gate transistor 803, coupled between first supply voltage 813 and first network node 837; a second network node 857 that is coupled to devices 801A, 801B and 801C; and a second back biased low threshold gate transistor 805, coupled between second network node 857 and a second supply voltage 815. As with devices 401 and 501 discussed above, devices 801A, 801B and 801C could be any of, or any combination of, numerous devices well known to those of skill in the art such as a transistors, inverters, latches, any one of several logic or memory gates, or any other logic or memory devices. In one embodiment of the invention, devices 801A, 801B and 801C are low power devices having a supply voltage of less than one volt (1.0 volt), and typically between one hundred fifty and four hundred millivolts (0.15 and 0.4 volts).

In low power supply gated network 800, first back biased low threshold gate transistor 803 is a PFET and includes: a source 833 coupled to first supply voltage 813; a gate 823 coupled to a control voltage source (not shown); and a drain 835 coupled to first network node 837. Likewise, second back biased low threshold gate transistor 805 is an NFET and includes: a drain 853 coupled to second network node 857, a gate 825 coupled to a control voltage source (not shown) and a source 855 coupled to second supply voltage 815. In one embodiment of the invention, first supply voltage 813 is positive and less than one volt (1.0 volt), and typically between one hundred fifty and four hundred millivolts (0.15 and 0.4 volts). In this embodiment, second supply voltage 815 is ground.

Low power supply gated network 800 is similar to low power supply gated component 400 discussed above and has all the advantages discussed above with respect to low power supply gated component 400, including the ability to overdrive on and overdrive off back biased low threshold gating transistors 803 and 805. In addition, low power supply gated network 800 includes back biased low threshold gating transistors 803 and 805 that include back bias terminals 863 and 865 and therefore can be back biased by providing bias voltages to back bias terminals 863 and 865.

As discussed above, back biasing provides a mechanism to modulate the threshold voltages of the first and second low threshold gating transistors between an off state and an on state. For a more detailed discussion, see the discussion above regarding low power supply gated component 500 and FIGS. 5 and 6.

By connecting multiple devices, such as 801A, 801B and 801C in FIG. 8, in a network and then gating the network with low threshold gating transistors, such as back biased low threshold gating transistors 803 and 805 in FIG. 8, an artificial ground is supplied to the network. Using this structure and method, the number of low power gating transistors required is minimized and therefore system cost is reduced. In addition, by sharing a network node 857, low power supply gated network 800 has the advantage that, if devices 801A, 801B and 801C do not switch simultaneously, gating transistor 805 only needs to be wide enough to supply current to one of devices 801A, 801B and 801C. Also, all the advantages of the invention discussed above, including the ability to overdrive on back biased low threshold gating transistors 803 and 805, the ability to overdrive off back biased low threshold gating transistors 803 and 805 and the ability to employ two types of low threshold transistors, a first type having a very low threshold voltage and a second type having a low threshold voltage, are retained.

FIG. 8B shows a schematic representation of a low power supply gated network 800B, in accordance with one embodiment of the invention, that is a variation of low power supply gated network 800 discussed above. Low power supply gated network 800B includes: devices 801A, 801B and 801C; a first network node 837 that is coupled to devices 801A, 801B and 801C; a single back biased low threshold gate transistor 803B, coupled between first supply voltage 813 and first network node 837; a second network node 857 that is coupled to devices 801A, 801B and 801C and a second supply voltage 815. As with devices 401 and 501 discussed above, devices 801A, 801B and 801C could be any of, or any combination of, numerous devices well known to those of skill in the art such as a transistors, inverters, latches, any one of several logic or memory gates, or any other logic or memory devices. In one embodiment of the invention, devices 801A, 801B and 801C are low power devices having a supply voltage of less than one volt (1.0 volt), and typically between one hundred fifty and four hundred millivolts (0.15 and 0.4 volts).

In low power supply gated network 800B, single back biased low threshold gate transistor 803B is a PFET and includes: a source 833 coupled to first supply voltage 813; a gate 823 coupled to a control voltage source (not shown); and a drain 835 coupled to first network node 837. In one embodiment of the invention, first supply voltage 813 is positive and less than one volt (1.0 volt), and typically between one hundred fifty and four hundred millivolts (0.15 and 0.4 volts). In this embodiment, second supply voltage 815 is ground.

Low power supply gated network 800B is similar to low power supply gated component 400B discussed above and has all the advantages discussed above with respect to low power supply gated component 400B, including the ability to overdrive on and overdrive off back biased low threshold gating transistor 803B. In addition, low power supply gated network 800B includes back biased low threshold gating transistor 803B that includes back bias terminal 863 and therefore can be back biased by providing bias voltage to back bias terminal 863.

FIG. 8C shows a schematic representation of a low power supply gated network 800C, in accordance with one embodiment of the invention, that is a variation of low power supply gated network 800 discussed above. Low power supply gated network 800C includes: devices 801A, 801B and 801C; a first network node 837 that is coupled to devices 801A, 801B and 801C and first supply voltage 813; a second network node 857 that is coupled to devices 801A, 801B and 801C; a single back biased low threshold gate transistor 805C, coupled between second network node 857 and second supply voltage 815. As with devices 401 and 501 discussed above, devices 801A, 801B and 801C could be any of, or any combination of, numerous devices well known to those of skill in the art such as a transistors, inverters, latches, any one of several logic or memory gates, or any other logic or memory devices. In one embodiment of the invention, devices 801A, 801B and 801C are low power devices having a supply voltage of less than one volt (1.0 volt), and typically between one hundred fifty and four hundred millivolts (0.15 and 0.4 volts).

In low power supply gated network 800C, single back biased low threshold gate transistor 805C is an NFET and includes: a drain 853 coupled to second network node 857, a gate 825 coupled to a control voltage source (not shown) and a source 855 coupled to second supply voltage 815. In one embodiment of the invention, first supply voltage 813 is positive and less than one volt (1.0 volt), and typically between one hundred fifty and four hundred millivolts (0.15 and 0.4 volts). In this embodiment, second supply voltage 815 is ground.

Low power supply gated network 800C is similar to low power supply gated component 400C discussed above and has all the advantages discussed above with respect to low power supply gated component 400C, including the ability to overdrive on and overdrive off back biased low threshold gating transistor 805C. In addition, low power supply gated network 800C includes back biased low threshold gating transistors 805C that includes back bias terminal 865 and therefore can be back biased by providing bias voltage to back bias terminal 865.

FIG. 8D shows a schematic representation of a low power supply gated network 800D, in accordance with one embodiment of the invention, that is a variation of low power supply gated network 800 discussed above. Low power supply gated network 800D includes: devices 801A, 801B and 801C; a first network node 837 that is coupled to devices 801A, 801B and 801C; a single back biased low threshold gate transistor 803D, coupled between first supply voltage 813 and first network node 837; a second network node 857 that is coupled to devices 801A, 801B and 801C and a second supply voltage 815. As with devices 401 and 501 discussed above, devices 801A, 801B and 801C could be any of, or any combination of, numerous devices well known to those of skill in the art such as a transistors, inverters, latches, any one of several logic or memory gates, or any other logic or memory devices. In one embodiment of the invention, devices 801A, 801B and 801C are low power devices having a supply voltage of less than one volt (1.0 volt), and typically between one hundred fifty and four hundred millivolts (0.15 and 0.4 volts).

In low power supply gated network 800D, single back biased low threshold gate transistor 803D is an NFET and includes: a drain 833 coupled to first supply voltage 813; a gate 823 coupled to a control voltage source (not shown); and a source 835 coupled to first network node 837. In one embodiment of the invention, first supply voltage 813 is positive and less than one volt (1.0 volt), and typically between one hundred fifty and four hundred millivolts (0.15 and 0.4 volts). In this embodiment, second supply voltage 815 is ground.

The fact that low power supply gated network 800D includes single back biased low threshold gate transistor 803D that is an NFET, and is coupled between first supply voltage 813 and first network node 837, is unique and is made practical only through the methods and structure of the invention. In the prior art, the use of an NFET as single low threshold gate transistor 803D would be impractical because exchanging NFETS and PFETS in the prior art severely degraded performance and was of extremely limited value. This was a result of the fact that with higher threshold voltages, and larger body effect, prior art NFETS passed digital lows or "0" efficiently but did not pass digital highs or "1" well. Similarly, prior art PFETs passed digital highs or "1" efficiently but did not pass digital lows or "0" well. However, according to the invention, the supply gate transistors can be overdriven as described above. Consequently, supply gate NFETs of the invention can pass both digital highs or "1" and digital lows or "0" well and supply gate PFETs of the invention can pass both digital lows or "0" and digital highs or "1" well. Therefore, using the method and structure of the invention, and in contrast to the prior art, low power supply gated component 800D can include a single low threshold gate transistor 803D that is a NFET and still operate efficiently.

Low power supply gated network 800D is similar to low power supply gated component 400D discussed above and has all the advantages discussed above with respect to low power supply gated component 400D, including the ability to overdrive on and overdrive off back biased low threshold gating transistor 803D. In addition, low power supply gated network 800D includes back biased low threshold gating transistor 803D that includes back bias terminal 863 and therefore can be back biased by providing bias voltage to back bias terminal 863.

FIG. 8E shows a schematic representation of a low power supply gated network 800E, in accordance with one embodiment of the invention, that is a variation of low power supply gated network 800 discussed above. Low power supply gated network 800E includes: devices 801A, 801B and 801C; a first network node 837 that is coupled to devices 801A, 801B and 801C; a single back biased low threshold gate transistor 803E, coupled between second network node 857 and second supply voltage 815; a second network node 857 that is coupled to devices 801A, 801B and 801C and a second supply voltage 815. As with devices 401 and 501 discussed above, devices 801A, 801B and 801C could be any of, or any combination of, numerous devices well known to those of skill in the art such as a transistors, inverters, latches, any one of several logic or memory gates, or any other logic or memory devices. In one embodiment of the invention, devices 801A, 801B and 801C are low power devices having a supply voltage of less than one volt (1.0 volt), and typically between one hundred fifty and four hundred millivolts (0.15 and 0.4 volts).

In low power supply gated network 800E, single back biased low threshold gate transistor 803E is a PFET and includes: a source 853 coupled to second supply voltage 815; a gate 825 coupled to a control voltage source (not shown); and a drain 855 coupled to second network node 857. In one embodiment of the invention, first supply voltage 813 is positive and less than one volt (1.0 volt), and typically between one hundred fifty and four hundred millivolts (0.15 and 0.4 volts). In this embodiment, second supply voltage 815 is ground.

The fact that low power supply gated network 800E includes single back biased low threshold gate transistor 803E that is a PFET, coupled between second network node 857 and second supply voltage 815, is unique and is made practical only through the methods and structure of the invention. In the prior art, the use of a PFET as single low threshold gate transistor 803E would be impractical because, exchanging NFETS and PFETS in the prior art severely degraded performance and was of extremely limited value. This was a result of the fact that with higher threshold voltages, and larger body effect, prior art NFETS passed digital lows or "0" efficiently but did not pass digital highs or "1" well. Similarly, prior art PFETs passed digital highs or "1" efficiently but did not pass digital lows or "0" well. However, according to the invention, the supply gate transistors can be overdriven as described above. Consequently, supply gate NFETs of the invention can pass both digital highs or "1" and digital lows or "0" well and supply gate PFETs of the invention can pass both digital lows or "0" and digital highs or "1" well. Therefore, using the method and structure of the invention, and in contrast to the prior art, low power supply gated component 800E can include a single low threshold gate transistor 803E that is a PFET and still operate efficiently.

Low power supply gated network 800E is similar to low power supply gated component 400E discussed above and has all the advantages discussed above with respect to low power supply gated component 400E, including the ability to overdrive on and overdrive off back biased low threshold gating transistor 803E. In addition, low power supply gated network 800E includes back biased low threshold gating transistors 803E that include back bias terminal 865 and therefore can be back biased by providing bias voltage to back bias terminal 865.

As discussed above, devices 801A, 801B, 801C can be any one of, or combination of, well known devices such as transistors, inverters, latches, logic gates and logic or memory devices. FIG. 9 shows a low power supply gated network 900 that includes devices 901A, 901B and 901C that are inverters.

Low power supply gated network 900 includes inverters 901A, 901B and 901C; a first network node 937 coupling sources 983A, 983B and 983C of first inverter transistors 981A, 981B and 981C, respectively; a first back biased low threshold gate transistor 903 coupled between first supply voltage 913 and first network node 937; a second network node 957 coupling sources 995A, 995B and 995C of second inverter transistors 991A, 991B and 991C, respectively; and a second back biased low threshold gate transistor 905 coupled between second network node 957 and a second supply voltage 915. In one embodiment of the invention, inverters 901A, 901B and 901C are low power inverters having a supply voltage of less than one volt (1.0 volt), and typically between one hundred fifty and four hundred millivolts (0.15 and 0.4 volts). In this embodiment, inverter transistors 981A, 981B, 981C, 991A, 991B and 991C are also low power and either low threshold or very low threshold transistors.

In low power supply gated network 900, first back biased low threshold gate transistor 903 is a PFET and includes: a source 933 coupled to first supply voltage 913; a gate 923 coupled to a control voltage source (not shown); and a drain 935 coupled to first network node 937. Likewise, second back biased low threshold gate transistor 905 is an NFET and includes: a drain 953 coupled to second network node 957, a gate 925 coupled to a control voltage source (not shown) and a source 955 coupled to second supply voltage 915. In addition, inverter transistors 981A, 981B and 981C include gates 987A, 987B, and 987C, respectively, that are coupled to gates 997A, 997B and 997C, respectively of inverter transistors 991A, 991B and 991C, respectively. In one embodiment of the invention, first supply voltage 913 is positive and less than one volt (1.0 volt), and typically between one hundred fifty and four hundred millivolts (0.15 and 0.4 volts). In this embodiment, second supply voltage 915 is ground.

Low power supply gated network 900 is similar to low power supply gated network 800 discussed above and has all the advantages discussed above with respect to low power supply gated network 800, including the ability to overdrive on and overdrive off back biased low threshold gating transistors 903 and 905 and/or a back biasing capability. In low power supply gated network 900, back biasing is accomplished using low threshold gating transistors 903 and 905 that include back bias terminals 963 and 965 and by providing bias voltages to back bias terminals 963 and 965. In addition, in one embodiment of the invention, inverter transistors 981A, 981B, 981C, 991A, 991B and 991C also include back bias terminals (not shown), and therefore can be back biased by providing bias voltages. In one embodiment of the invention, threshold gating transistors 903 and 905 and inverter transistors 981A, 981B, 981C, 991A, 991B and 991C are identically back biased by the same voltage sources. In another embodiment of the invention, threshold gating transistors 903 and 905 and inverter transistors 981A, 981B, 981C, 991A, 991B and 991C are each separately back biased by the different voltage sources.

In addition, according to one embodiment of the invention, two types of low threshold transistors are employed in low power supply gated networks 800 and 900; a first type having a very low threshold voltage (Vth1) of approximately zero volts (0.0 volts) and a second type having a low threshold voltage (Vth2) of approximately one hundred and fifty millivolts (150 millivolts).

Using the embodiment of the invention shown in FIG. 9 as an example, the very low threshold transistors of the first type, i.e., the Vth1 transistors, are used within inverters 901A, 901B and 901C, i.e., as inverter transistors 981A, 981B, 981C, 991A, 991B and 991C, while the low threshold transistors of the second type, i.e., the Vth2 transistors, are used as low threshold gating transistors 903 and 905. Since, in this embodiment of the invention, low threshold gating transistors 903 and 905 have higher threshold voltages than inverter transistors 981A, 981B, 981C, 991A, 991B and 991C, low threshold gating transistors 903 and 905 have lower leakage and provide a gating function to isolate inverters,901A, 901B, and 901C from the supply voltages 913 and 915. However, since gating transistors 903 and 905 still have threshold voltages significantly lower than prior art gating transistors, the resulting low power supply gated network 900 is still a low power component with decreased active power dissipation and the same performance at a lower supply voltage.

As noted above, two types of low threshold transistors can be employed in each embodiment of the invention and this method is not limited to use with the embodiment of the invention shown in FIG. 9. Indeed the methods of reducing leakage current using the invention discussed above are by no means mutually exclusive and it is anticipated that they will be used in combination to achieve the desired results. In one embodiment of the invention, all four methods are employed in a single device.

According to the invention, the low threshold gating transistors can be overdriven on so that the resistance added by including gating transistors is minimized and device performance is enhanced. This is in contrast to the prior art gating transistors that added significant resistance and decreased performance in terms of decreased device speed and increased heat production. In one embodiment of the invention, the performance enhancement of the present invention is obtained, in contrast to the prior art, without increasing the size of the gating transistors relative to the size of the transistors making up the device.

In addition, if even less resistance is desired, according to the invention, the size of gating transistors of the invention can be increased and the transistor can still be overdriven according to the invention. Consequently, using the invention, there is an approach for resistance reduction available that was not available in the prior art and can provide orders of magnitude decrease in added resistance. Therefore, the invention can provide the advantages of supply gating without the large performance penalty associated with the prior art.

In addition, the gating transistors of the invention can be overdriven off. By overdriving the gating transistors of the invention off, the transistor can be forced into an off condition where the leakage current is minimized. This improvement is possible because, according to the invention, and unlike the prior art, the gating transistors are low threshold devices.

In addition, according to one embodiment of the invention, low threshold transistors of a first type are used within the low power device while the low threshold transistors of the second type are used as gating transistors. Since, in this embodiment of the invention, the gating transistors have higher threshold voltages than the device transistors threshold voltages, the gating transistors have lower leakage and provide a gating function to isolate the low power device from the supply voltages.

In one embodiment of the invention, the low threshold gating transistors are provided with back bias to modulate the threshold voltages of the first and second low threshold gating transistors between an off state and an on-state. The use of back bias is particularly advantageous with embodiments of the invention where low threshold transistors of the second type, i.e., the Vth2 transistors discussed above, are used as the gating transistors. This is because, as discussed above, higher threshold voltage means the transistors exhibit more body effect and the more body effect means that back biasing is more effective.

Consequently, using the method and apparatus of the invention, the power dissipation of a device in standby mode is decoupled from leakage current using circuitry to control the leakage current in low threshold transistors and devices. Therefore, using the invention, the threshold voltage of a device is lowered and the active power dissipation is decreased by permitting the same performance to be achieved at a lower supply voltage. However, using the invention, the large increase in device leakage and standby power dissipation typically associated with lowering the threshold voltage of a device is avoided.

This Application is related to: U.S. Pat. No. 5,773,863 entitled "Low Power, High Performance Junction Transistor"; U.S. Pat. No. 5,780,912 entitled "Asymmetric Low Power MOS Devices "; U.S. Pat. No. 5,622,880 entitled "Method of Making a Low Power, High Performance Junction Transistor"; U.S. Pat. No. 5,753,958 entitled "Back biasing in Asymmetric MOS Devices"; U.S. Pat. No. 5,650,340 entitled "Method for Making Asymmetric Low Power Devices"; U.S. Pat. No. 5,719,422, entitled "Low Threshold Voltage, High Performance Junction Transistor"; U.S. Pat. No. 6,137,142 entitled "MOS Device Structure and Method for Reducing PN Junction Leakage"; U.S. Pat. No. 6,110,783 entitled "Method for Forming a Notched Gate Oxide Asymmetric MOS Device"; U.S. Pat. No. 6,121,666 entitled "Split Gate Oxide Asymmetric MOS Device"; U.S. Pat. No. 6,093,951 entitled "MOS Devices With Retrograde Pocket Regions"; U.S. Pat. No. 5,985,727 entitled "Method for Forming MOS Devices with Retrograde Pocket Regions and Counter Dopant Regions Buried in the Substrate Surface"; U.S. Pat. No. 5,923,987 entitled "Method for Forming MOS Devices with Retrograde Pocket Regions and Counter Dopant Regions Buried in the Substrate Surface"; U.S. Pat. No. 5,942,781 entitled "Tunable Threshold SOI Device Using Back Gate Well"; U.S. Pat. No. 6,100,567 entitled "Tunable Threshold SOI Device Using Back Gate and Intrinsic Channel Region"; U.S. Pat. No. 6,072,217 entitled "Tunable Threshold Device Using Isolated Well Structure for Back Gate"; U.S. Pat. No. 6,048,746 entitled "Methods for Making Die-Compensated Threshold Tuning Circuit"; U.S. Pat. No. 6,087,892 entitled "Target Ion/Ioff Threshold Tuning Circuit and Method"; U.S. Pat. No. 5,998,850 entitled "Tunable Field Plate"; U.S. Pat. No. 6,091,283 entitled "Sub-Threshold Leakage Tuning Circuit"; U.S. Pat. No. 5,471,421 entitled "Storage Cell Using Low Powered/Low Threshold CMOS Pass Transistors Having Reduced Charge Leakage"; U.S. Pat. No. 5,581,500 entitled "Memory Cell with Power Supply Induced Reversed-Bias Pass Transistors for Reducing Off-Leakage Current"; U.S. Pat. No. 5,566,120 entitled "Apparatus and Method for Controlling Transistor Current Leakage"; U.S. Pat. No. 6,606,270 entitled "Dynamic Clocked Inverter Latch with Reduced Charge Leakage"; U.S. Pat. No. 5,612,645 entitled "Dynamic MOSFET Threshold Voltage Controller"; U.S. Pat. No. 5,640,115 entitled "Self-Enabling Latch"; and U.S. patent application Ser. No. 09/030,030, now allowed, entitled "Back biased MOS Device and Method" all of which are assigned to the assignee of the present invention and are incorporated herein, in their entirety, by reference for all purposes.

The foregoing description of an implementation of the invention has been presented for purposes of illustration and description, and therefore is not exhaustive and does not limit the invention to the precise form disclosed. Modifications and variations are possible in light of the above teachings or may be acquired from practicing the invention. Consequently, the scope of the invention is defined by the claims and their equivalents.

What is claimed is:

1. A low power supply gated network comprising:

a first supply voltage;

two or more devices;

a second supply voltage;

a first back biased low threshold gating transistor coupled between said first supply voltage and said two or more devices;

a second back biased low threshold gating transistor coupled between said two or more devices and said second supply voltage; wherein, said first and second back biased low threshold gating transistors have an unbiased threshold voltage with a magnitude of less than 300 millivolts;

a first back bias potential supplied to said first back biased low threshold gating transistor to modulate said threshold voltage of said first back biased low threshold gating transistor between an off-state and an on state; and a second back bias potential supplied to said second back biased low threshold gating transistor to modulate said threshold voltage of said second back biased low threshold gating transistor between an off-state and an on state.

* * * * *